US006359596B1

(12) United States Patent
Claiborne

(10) Patent No.: US 6,359,596 B1
(45) Date of Patent: Mar. 19, 2002

(54) INTEGRATED CIRCUIT MM-WAVE ANTENNA STRUCTURE

(75) Inventor: Lewis Taylor Claiborne, Richardson, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/628,090

(22) Filed: Jul. 28, 2000

(51) Int. Cl.[7] ..... H01Q 9/28
(52) U.S. Cl. ..... 343/795; 343/797; 343/799
(58) Field of Search ..... 343/700 MS, 792.5, 343/795, 798, 797, 799, 800, 895

(56) References Cited

U.S. PATENT DOCUMENTS

| | | | | | |
|---|---|---|---|---|---|
| 4,686,536 | A | * | 8/1987 | Allcock | 343/700 MS |
| 5,021,799 | A | | 6/1991 | Kobus et al. | 343/700 |
| 5,592,185 | A | | 1/1997 | Itabashi et al. | 343/794 |
| 5,598,169 | A | | 1/1997 | Drabeck et al. | 343/701 |
| 5,696,372 | A | | 12/1997 | Grober et al. | 250/216 |
| 5,719,586 | A | | 2/1998 | Tuttle | 343/726 |
| 5,943,025 | A | * | 8/1999 | Benham et al. | 343/795 |
| 6,008,773 | A | * | 12/1999 | Matsuoka et al. | 343/700 MS |
| 6,037,911 | A | | 3/2000 | Brankovic et al. | 343/795 |
| 6,121,935 | A | * | 9/2000 | Reece et al. | 343/795 |
| 6,163,306 | A | * | 12/2000 | Nakamura et al. | 343/797 |

* cited by examiner

*Primary Examiner*—Don Wong
*Assistant Examiner*—Hoang Nguyen
(74) *Attorney, Agent, or Firm*—Sidley Austin Brown & Wood; Stephen S. Sadacca

(57) ABSTRACT

An antenna array structure is disclosed for use in receiving, transmitting, or transceiving electromagnetic radiation. The antenna array structure includes a first planar substrate with one or more grooves formed therein with at least one secondary planar substrate having an antenna formed thereon placed in one of the grooves in the first substrate. The use of this three-dimensional structure takes advantage of the inherent directionality due to the guidance of electromagnetic radiation by the secondary planar substrate. This antenna array structure provides the advantages of reduced cross talk between adjacent antennae and can readily be produced using standard silicon fabrication techniques.

59 Claims, 5 Drawing Sheets

INTEGRATED CIRCUIT MM-WAVE ANTENNA STRUCTURE

FIELD OF THE INVENTION

The present invention relates to an integrated circuit antenna structure for use in receiving, transmitting, and/or transceiving millimeter waves. In particular, the present invention relates to a three-dimensional integrated circuit antenna structure.

BACKGROUND

Arrays of millimeter- (mm-) wave antennas have application to a number of imaging systems including security, robotic vision, and imaging through smoke or weather related obscurants. More recently, monolithic arrays of mm-wave antennas have been explored for use in these applications due to the simplicity of their fabrication on a single substrate.

However, monolithic mm-wave antenna arrays developed to date suffer from the problem of strong coupling of the mm-wave antennae to the dielectric substrate upon which they are formed as well as a closely spaced groundplane. This substrate coupling leads to poor efficiency in the mm-wave antennae. Poor efficiency of the mm-wave antennae results in poor imaging when the mm-wave antenna array is used in a passive mode. To improve imaging, a mm-wave illumination source can be used to increase the quantity of received mm-wave radiation. The use of a mm-wave illumination source is either not feasible or is undesirable in many applications, especially military applications.

The substrate coupling also leads to significant cross talk problems between mm-wave antennae within an array. This cross talk reduces image fidelity, thereby requiring improved signal processing of the resultant antenna signals. Alternatively, the spacing between adjacent mm-wave antennae within an array must be increased. However, increasing the spacing between adjacent mm-wave antennae reduces image resolution, which is undesirable.

SUMMARY

It is an object of the present invention to provide an integrated circuit antenna array with significantly reduced substrate coupling. It is a further object of the present invention to provide an integrated circuit antenna array that can be produced at low cost using standard silicon fabrication techniques.

In a first embodiment, the present invention includes a single integrated circuit antenna for receiving, transmitting, or transceiving electromagnetic radiation. The first embodiment includes a first substrate having at least one first electrical lead formed on a surface thereof. The first embodiment also includes a second substrate having an antenna for receiving, transmitting, or transceiving electromagnetic radiation formed on a surface thereof and at least one second electrical lead. One end of the at least one second electrical lead is electrically connected to the antenna, while a second end of the at least one second electrical lead is positioned adjacent to an edge of the second substrate. The second substrate is disposed with respect to the first surface of the first substrate such that the at least one first electrical lead is electrically connected to a corresponding one of the second electrical lead.

In a second embodiment, the present invention includes a plurality of integrated circuit antennae for receiving, transmitting, or transceiving electromagnetic radiation. The second embodiment includes a first substrate having a plurality of first electrical leads formed on a surface thereof. The second embodiment also includes at least one secondary substrate having at least one antenna for receiving, transmitting, or transceiving electromagnetic radiation formed on a surface thereof and a corresponding at least one second electrical lead for each antenna formed thereon. One end of each of the at least one second electrical lead is electrically connected to a corresponding antenna, while a second end of the at least one second electrical lead is positioned adjacent to an edge of a corresponding second substrate. Each of the at least one secondary substrate is disposed with respect to the first surface of the first substrate such that each of the ends of the plurality of first electrical leads is electrically connected to a corresponding one of the second electrical leads.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
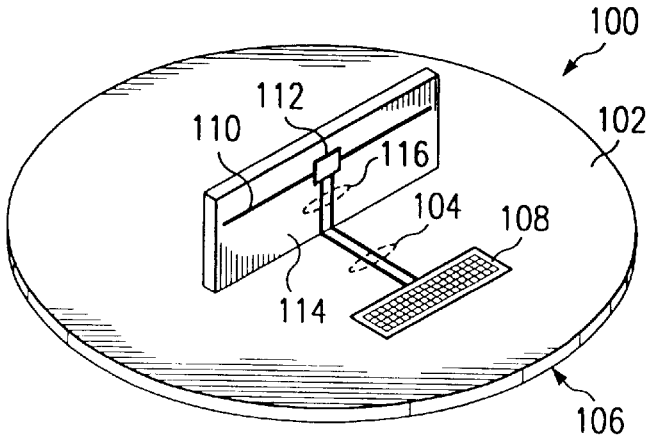
FIG. 1 is a perspective view of an integrated circuit antenna structure according to a first embodiment of the present invention.

FIG. 1 illustrates a perspective view of a first embodiment of an integrated circuit antenna structure 100. The first embodiment includes a first substrate 102, preferably a silicon wafer. A first electrical lead 104 is formed on a top major surface of the first substrate 102. A ground plane 106 is optionally formed on the bottom major surface of the first substrate 102. The first electrical lead 104 and the ground plane 106 are preferably layers of aluminum or an aluminum alloy and formed by standard silicon integrated circuit fabrication techniques.

Figure 2:
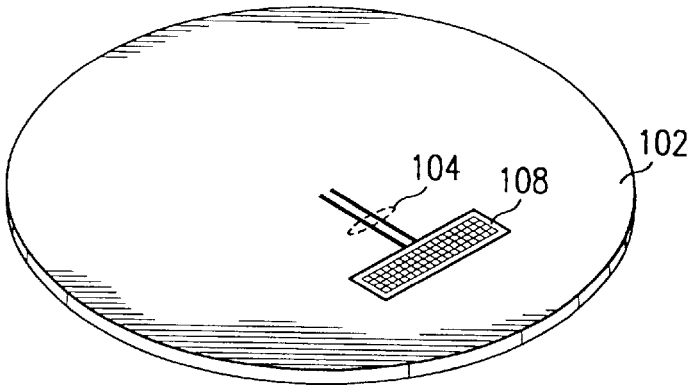
FIG. 2 is a top view of a first planar substrate according to a first embodiment of the present invention.

Various electronic circuitry 108 is optionally formed on the surface of the first substrate 102 as seen in FIG. 2. This electronic circuitry 108 serves one of three functions depending upon the particular application for the integrated circuit antenna structure 100. If the integrated circuit antenna structure 100 is to be used for receiving mm-wave electromagnetic radiation, the electronic circuitry 108 will be used for detecting a change in resistance, voltage, or current imposed on the first electrical lead 104 by an antenna 110, or an antenna load 112.

In some applications, the integrated circuit antenna structure 100 can be used for transmitting mm-wave electromagnetic radiation. In these cases, the electronic circuitry 108 will be used to generate an appropriate drive current or voltage to be conducted to the antenna 110 via the first electrical lead 104. If the integrated circuit antenna structure 100 is to be used for transceiving mm-wave electromagnetic radiation, the electronic circuitry will be used to both detect the change in resistance, current, or voltage in the first electrical lead 104, as well as to generate an appropriate drive current or voltage in the first electrical lead 104. Depending upon the application and the frequency of the electromagnetic radiation, stripline, microstrip, or twin leads may be required for the first electrical lead 104.

Figure 3A:
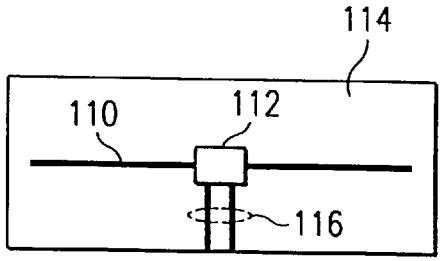
FIG. 3*a* is a side view of a second planar substrate showing an integrated circuit antenna according to a first embodiment of the present invention and 3*b* is a side view of a second planar substrate showing an integrated circuit antenna and a director according to a first embodiment of the present invention.
Figure 3B:
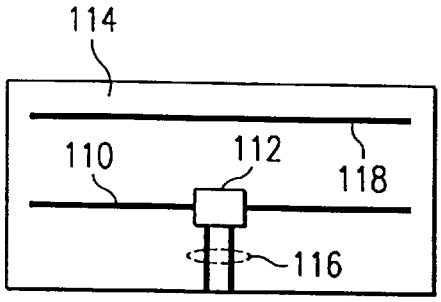

The integrated circuit antenna structure 100 further includes a second substrate 114 as seen in FIG. 3*a,* preferably a silicon wafer. The second substrate 114 has the antenna 110 formed on the major surface thereof. In the gap between the antenna 110 halves, the antenna load 112 may be optionally formed. This antenna load 112 absorbs the mm-wave electromagnetic radiation energy absorbed by the antenna 110. The temperature of the antenna load 112 may increase due to the absorbed energy, thereby causing the impedance of the antenna load 112 to change. Alternatively, the absorbed energy may cause a change in the voltage or current across the antenna load 112. A second electrical lead 116 is formed on a surface of the second substrate 114. A first end of the second electrical lead 116 is electrically connected to a corresponding end of the antenna 110 or antenna load 112. A second end of the second electrical lead 116 is adjacent to an edge of the second substrate 114. The second electrical lead 116 is used to sense a change in the resistance, voltage, or current in the antenna 110 or antenna load 112 when the antenna is used to receive mm-wave electromagnetic radiation. A director 118 is optionally formed on a surface of the second substrate 114 as seen in FIG. 3*b*. The director 118 provides additional directivity to any mm-wave electromagnetic radiation transmitted or received by the antenna 110. The antenna 110, the second electrical lead 116, and the director 118 are preferably aluminum and formed by standard silicon integrated circuit fabrication techniques. The optional antenna load 112 is preferably a bolometer formed of a material having a high temperature coefficient of resistance, such as vanadium oxide. The antenna load 112 is also preferably formed by standard silicon integrated circuit fabrication techniques.

Fabrication of the integrated circuit antenna structure 100 is complete when the second substrate 114 is disposed with respect to the first surface of the first substrate 102 such that the first electrical lead 104 is electrically connected to the second end of the second electrical lead 116. Preferably, an angle θ formed between the first substrate 102 and the second substrate 114 is 90 degrees. In any case, the angle θ formed between the first substrate 102 and the second substrate 114 is non-zero, i.e. the first substrate 102 and the second substrate 114 are not parallel. A non-electrically conducting epoxy, not illustrated, can be used to secure the second substrate 114 to the surface of the first substrate 102.

Figure 4A:
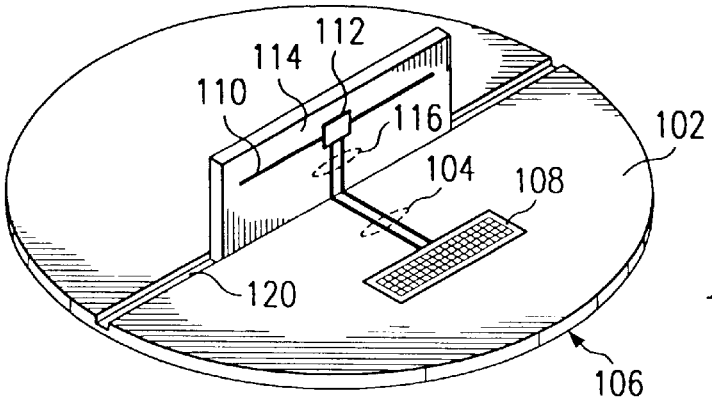
FIGS. 4*a–c* illustrate possible alternative fabrication techniques for use with the present invention.
Figure 4B:
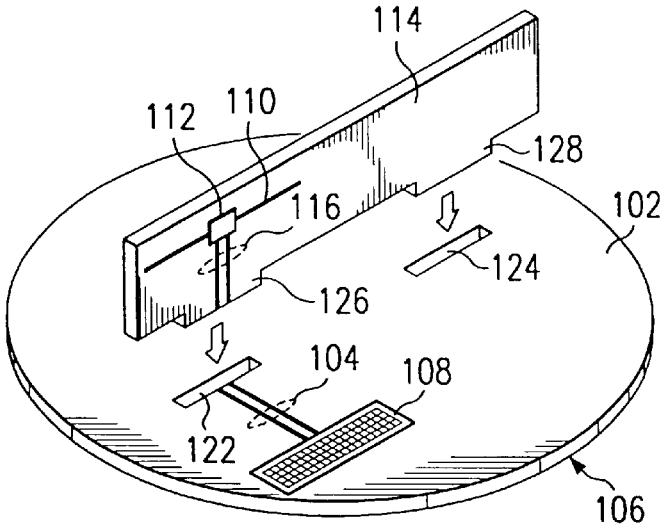
Figure 4C:
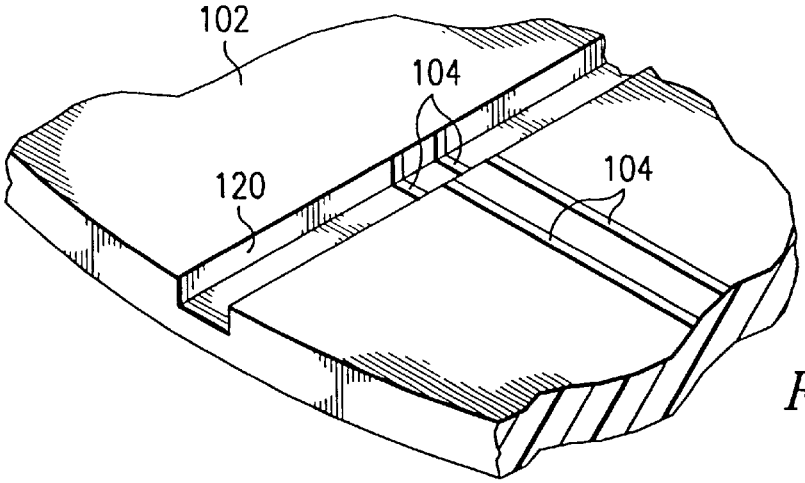

Alternative methods for fabricating the integrated circuit antenna structure 100 are shown in FIGS. 4*a*–4*c*. FIG. 4*a* illustrates the use of a channel 120 formed in the surface of the first substrate 102. The edge of the second substrate 114 is then placed in the channel 120 such that the first electrical lead 104 is aligned and in electrical contact with the second electrical lead 116. FIG. 4*b* illustrates the use of two slots 122, 124 formed through the first substrate 102. The edge of the second substrate 114 is then processed to form corresponding tabs 126, 128. The tabs 126, 128 are then placed in the slots 122, 124 such that the first electrical lead 104 is aligned and in electrical contact with the second electrical lead 116. An alternative method for fabricating the first electrical lead 104 is shown in FIG. 4*c*. With this alternative method, the first electrical lead 104 is formed with a portion on the edge of the channel 120 in the first substrate 102. By placing a portion of the first electrical lead 104 on the edge of the channel 120, a larger conducting surface can be provided thereby improving the electrical contact between the first electrical lead 104 and second electrical lead 116. In each of these fabrication methods a first electrical lead 104 is in direct electrical and physical contact with a corresponding second electrical lead 116.

Figure 5A:
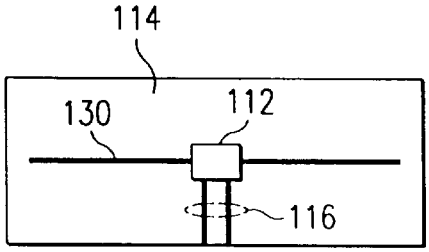
FIGS. 5*a–d* illustrate possible antenna configurations for use with the present invention.
Figure 5B:
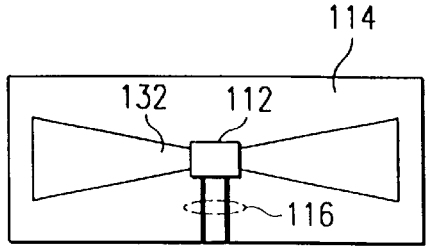
Figure 5C:
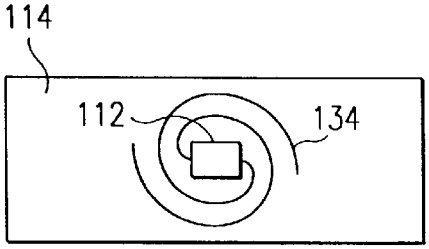
Figure 5D:
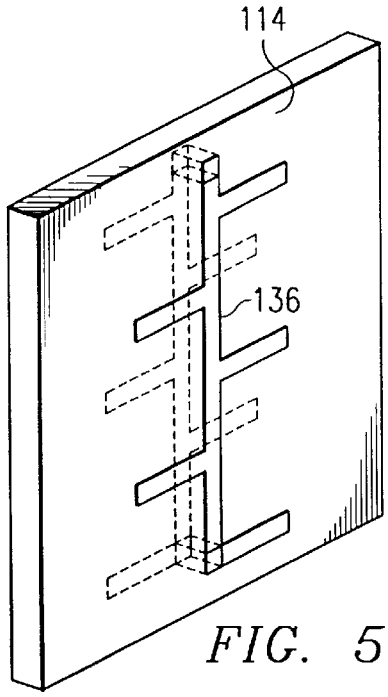

As shown in FIGS. 5*a*–5*d,* a variety of integrated circuit antenna configurations is possible. In the simplest case, as illustrated in FIG. 5*a,* the antenna can be a dipole antenna 130. The dipole antenna provides the narrowest bandwidth of mm-wave electromagnetic radiation. In applications with low received mm-wave electromagnetic radiation power, a broad bandwidth integrated circuit antenna configuration is preferable to increase received signal strength. A first example of a broad bandwidth integrated circuit antenna configuration is a bow tie antenna 132 illustrated in FIG. 5*b*. A broader bandwidth integrated circuit antenna configuration is achieved by using a spiral antenna 134 illustrated in FIG. 5*c*. A third broadband antenna configuration is illustrated in FIG. 5*d*. The third broadband antenna is a log periodic antenna 136 having antenna legs of differing lengths. Further, the antenna legs may be fabricated on both sides of the second substrate providing greater flexibility in design of the antenna. When the antenna is fabricated on both sides of the substrate, the material used for the second substrate must be carefully selected for both dielectric constant and thickness. Broad bandwidth integrated circuit antenna configurations using the bow tie antenna 132, the spiral antenna 134, or the log periodic antenna 136 can be used in various transmission or transceiver applications. As examples, a system requiring the transmission of modulated mm-wave signals or a spread spectrum application that requires very broad bandwidth would each benefit from the use of the bow tie antenna 132, the spiral antenna 134, or the log periodic antenna 136.

Figure 6:
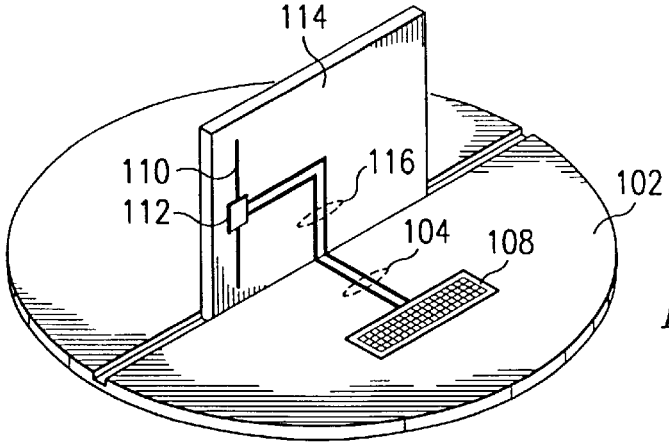
FIG. 6 is a perspective view of an alternative integrated circuit antenna structure configuration according to the first embodiment of the present invention.

In the integrated circuit antenna structure 100, where a longitudinal axis of the antenna 110 is parallel with the surface of the first substrate 102, a transmitted mm-wave would propagate very strongly in a direction normal to the surface of the first substrate 102 and centered with respect to the antenna 110. This directionality is due to the transmitted mm-wave preferentially propagating down the length of the second substrate 114 and the ground plane 106 on the bottom surface of the first substrate 102. An alternative configuration, illustrated in FIG. 6, includes the antenna 110 oriented with its longitudinal axis normal to the surface of the first substrate 102 and does not include the ground plane 106 on the bottom of the first substrate 102. In this case, a transmitted mm-wave again preferentially propagates down the length of the second substrate 114 resulting in the mm-wave propagating in a direction parallel to the surface of the first substrate 102 and parallel to the surface of the second substrate 114.

In a second embodiment of the present invention, a plurality of integrated circuit antennae are incorporated. FIGS. 7*a*–*f* illustrate the second embodiment of the present invention incorporating from 2 to 16 antennae.

Figure 7A:
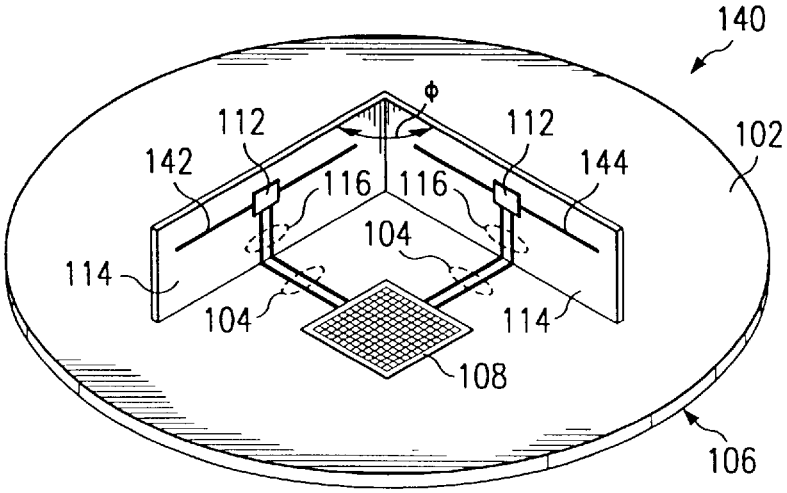
FIGS. 7*a–f* are perspective views of integrated circuit antenna array structure configurations according to a second embodiment of the present invention.
Figure 7B:
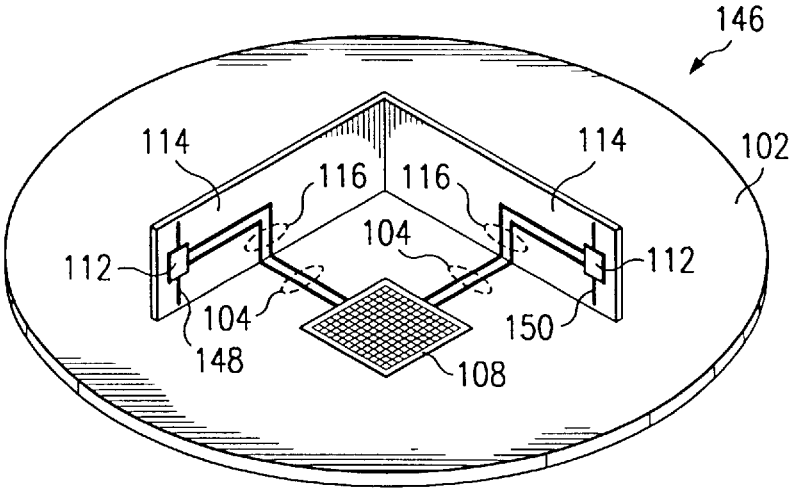

FIG. 7*a* illustrates a simple integrated circuit multi-antenna array structure 140 that incorporates only two antennae 142, 144 such that an angle $\phi$ between the two antennae 142, 144 is 90 degrees. With the axis of the two antennae 142, 144 parallel to the surface of the first substrate 102, the response to received mm-wave electromagnetic radiation can be approximately doubled as the antennae 142, 144 can absorb both orthogonal polarizations of the incident mm-wave electromagnetic radiation. When the axis of the two antennae 148, 150 is normal to the surface of the first substrate 102, as shown in FIG. 7*b*, the directionality of the integrated circuit multi-antenna array structure 146 is dramatically increased. When the integrated circuit multi-antenna array structure 146 is used for transmitting mm-wave electromagnetic radiation, the introduction of an appropriate phase difference between the currents or voltages used to drive the two antennae 148, 150 can result in directional transmission of the mm-wave electromagnetic radiation in any angular direction about an axis formed by the intersection of the planes of the two antennae 148, 150, thereby forming a phased array.

Figure 7C:
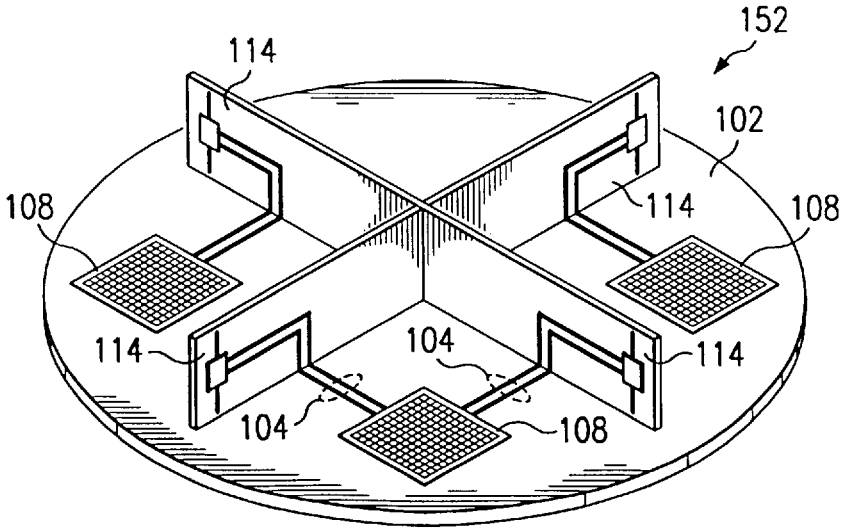
Figure 7D:
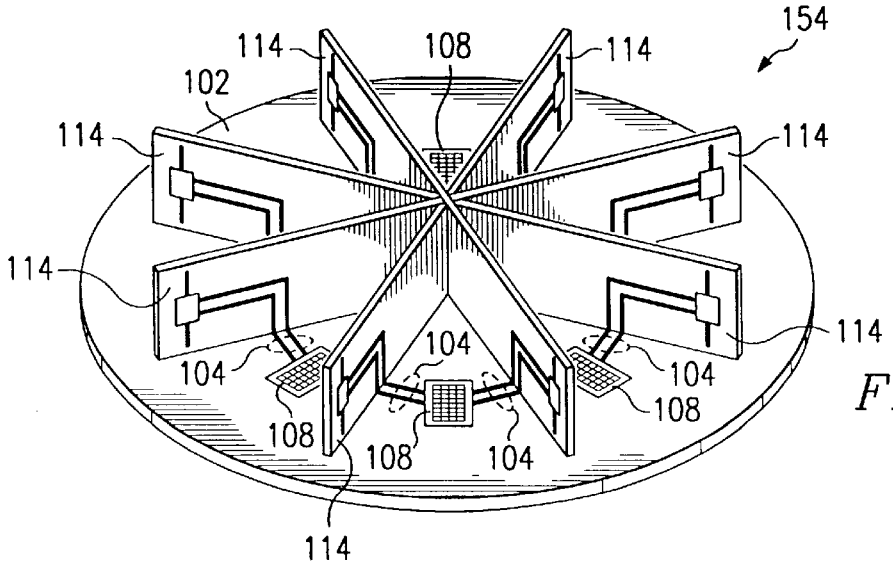

FIGS. 7*c* and 7*d* illustrate integrated circuit multi-antenna array structures 152, 154 that include 4 and 8 antennae respectively with an axis of each antenna normal to the surface of the first substrate 102. The advantage of the 4 and 8 integrated circuit multi-antenna array structures 152, 154 is their enhanced angular direction control relative to the two antenna integrated circuit multi-antenna array structure 146. The integrated circuit multi-antenna array structures 152, 154 also provide for an easier method of transmitting higher mm-wave electromagnetic radiation power.

The enhanced angular direction control of the integrated circuit multi-antenna array structures 152, 154 is also advantageous when used for receiving mm-wave electromagnetic radiation. By measuring a phase difference in the signals received by each of the plurality of antennae, the direction from which the radiation emanated can be ascertained. This has potential use in remote sensing applications where the integrated circuit multi-antenna array structure 152, 154 can be used to sense objects moving in a given area, for example animals by a water hole or military personnel or equipment in a battle field.

Figure 7E:
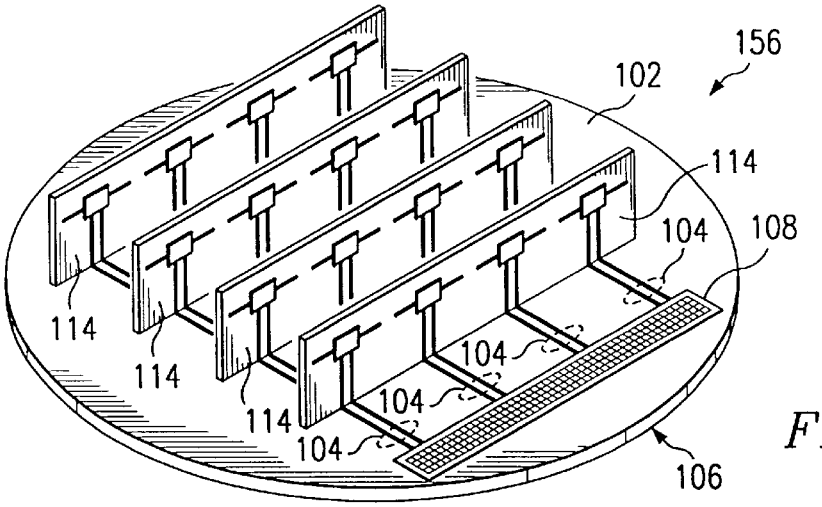
Figure 7F:
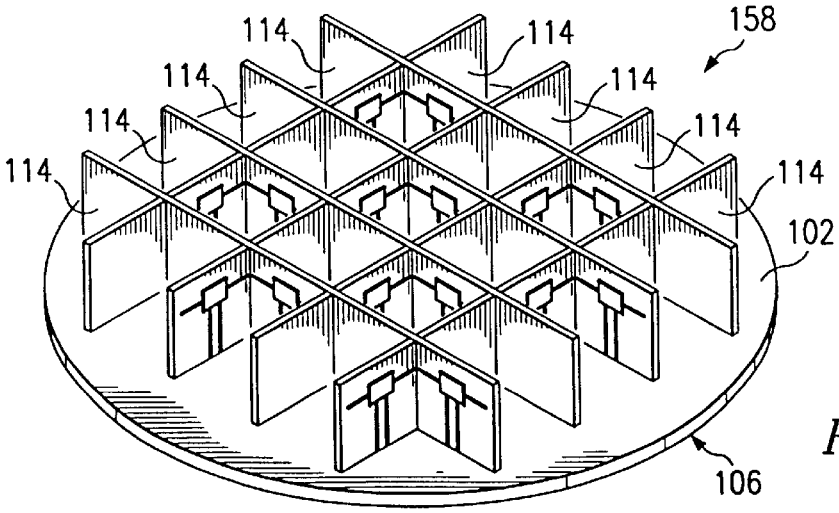

FIGS. 7*e* and 7*f* illustrate small mm-wave electromagnetic radiation sensing integrated circuit multi-antenna array structures 156, 158 for use in producing mm-wave electromagnetic radiation images. FIG. 7*e* illustrates an integrated circuit multi-antenna array structure 156 of 16 antennae that have the axis of each antenna parallel to the surface of the first substrate 102 and parallel to each other. FIG. 7*f* illustrates an integrated circuit multi-antenna array structure 158 of 16 antennae that have the axis of each antenna parallel to the surface of the first substrate 102, but alternate with respect to each other such that both polarizations of the incident mm-wave electromagnetic radiation can be absorbed. In either integrated circuit multi-antenna array structure 156, 158, the optional antenna load 112 would preferably be formed for each antenna. The optional electronic circuitry 108 would preferably be formed on the surface of the first substrate 102 such that the change in resistance, voltage, or current in the antenna 110 or its corresponding antenna load 112 would be sensed. This change in resistance, voltage, or current could then be used to form an image based upon mm-wave electromagnetic radiation, much like an optical focal plane array uses photodetectors and appropriate readout electronics to produce an image based upon visible or infrared electromagnetic radiation.

While the present invention has been described by way of example, a number of variations will be apparent to one skilled in the art. Such variations include, but are not limited to, the use of planar substrates other than silicon. The first planar substrate could be formed of GaAs to take advantage of GaAs electronics for certain transmitter or transceiver applications. The second planar substrate could be formed of suitable dielectric material that may provide better mm-wave electromagnetic radiation guiding properties, lower absorption of the mm-wave electromagnetic radiation, or better thermal properties. The prior art discloses a large number of antenna configurations of which only the dipole antenna, the bow tie antenna, and the spiral antenna have been illustrated. Alternative antenna configurations may provide various advantages for certain receiver, transmitter, or transceiver applications. A number of alternative antenna loads for the antennae can also be found in the prior art. These alternative antenna loads include materials other than vanadium oxide for use in a bolometer-type load such as bismuth. Antenna loads other than bolometers can also be used as long as the mm-wave electromagnetic radiation is absorbed and a suitable measurable indicia is produced.

While this Detailed Description elaborates upon embodiments of the invention as it relates specifically to small arrays of mm-wave integrated circuit antennae, this is not meant to limit application of the invention. Alternative embodiments may incorporate different configurations, substitutions, and modifications without departing from the scope of the invention.

What is claimed is:

1. An integrated circuit antenna structure for transmitting, receiving, or transceiving electromagnetic radiation, the antenna structure comprising:

a first substrate having a first surface;

at least one first electrical lead formed on the first surface of the first substrate;

a second substrate having a first surface and a first edge;

an antenna for transmitting, receiving, or transceiving electromagnetic radiation, wherein the antenna is formed on the first surface of the second substrate; and at least one second electrical lead formed on the second substrate, a first end of the at least one second electrical lead being electrically connected to the antenna, a second end of each second electrical lead being positioned adjacent the first edge of the second substrate, wherein the first edge of the second substrate is mounted to the first surface of the first substrate such that each first electrical lead is electrically connected to the second end of a corresponding second electrical lead, and wherein at least one of said first and second substrates is a semi-conductor.

2. An integrated circuit antenna structure in accordance with claim 1, wherein the first substrate further includes electronic circuitry formed on at least one surface thereof, wherein the electronic circuitry is electrically connected to the at least one first electrical lead, and wherein the electronic circuitry is adapted for driving the at least one first electrical lead such that the antenna transmits electromagnetic radiation.

3. An integrated circuit antenna structure in accordance with claim 1, wherein the first substrate further includes electronic circuitry formed on at least one surface thereof, wherein the electronic circuitry is electrically connected to the at least one first electrical lead, and wherein the electronic circuitry is adapted for receiving an electrical signal, from the at least one first electrical lead, indicative of the antenna receiving electromagnetic radiation.

4. An integrated circuit antenna structure in accordance with claim 1, wherein the first substrate further includes electronic circuitry formed on at least one surface thereof, wherein the electronic circuitry is electrically connected to the at least one first electrical lead, wherein the electronic circuitry is adapted for driving the at least one first electrical lead such that the antenna transmits electromagnetic radiation, and wherein the electronic circuitry is adapted for receiving an electrical signal, from the at least one first electrical lead, indicative of the antenna receiving electromagnetic radiation.

5. An integrated circuit antenna structure in accordance with claim 1, wherein the second substrate is directly mounted to the first substrate at a non-zero angle so that each first electrical lead physically contacts the second end of a corresponding second electrical lead.

6. An integrated circuit antenna structure in accordance with claim 1, wherein the first surface of the first substrate further defines at least one slot formed therein, wherein the first edge of the second substrate has at least one tab, wherein the at least one first electrical lead is at least partially formed within the at least one slot, wherein at least one of the at least one tab having a second electrical lead formed at least partially thereon, and wherein each tab is adapted to be positioned in a respective slot, and such that the at least one first electrical lead within the at least one slot is electrically coupleable to the second electrical lead on the at least one tab.

7. An integrated circuit antenna structure in accordance with claim 1, wherein an angle formed between the first substrate and the second substrate is substantially 90 degrees.

8. An integrated circuit antenna structure in accordance with claim 1, wherein a surface of the second substrate includes a director formed thereon, the director increasing the directionality of electromagnetic radiation emitted or received by the antenna.

9. An integrated circuit antenna structure in accordance with claim 1, wherein the antenna is one of a dipole antenna, a bow-tie antenna, a spiral antenna, and a log periodic antenna.

10. An integrated circuit antenna structure in accordance with claim 1, wherein a ground plane is formed on a second surface of the first substrate, the second surface of the first substrate being opposite the first surface of the first substrate.

11. An integrated circuit antenna structure in accordance with claim 1, wherein a longitudinal axis of the antenna is parallel to the first surface of the first substrate.

12. An integrated circuit antenna structure in accordance with claim 1, further including an antenna load electrically connected to the antenna, the antenna load converting electromagnetic radiation received by the antenna into an electrical indicia thereof.

13. An integrated circuit antenna structure in accordance with claim 12, wherein the electrical indicia is one of a change in resistance, a change in voltage, and a change in current.

14. An integrated circuit antenna structure in accordance with claim 1, wherein the first substrate is planar.

15. An integrated circuit antenna structure in accordance with claim 1, wherein the second substrate is planar.

16. An integrated circuit antenna structure for transmitting, receiving, or transceiving electromagnetic radiation, the antenna structure comprising:

a first substrate having a first surface;

at least one first electrical lead formed on the first surface of the first substrate;

a second substrate having a first surface and a first edge;

an antenna for transmitting, receiving, or transceiving electromagnetic radiation, wherein the antenna is formed on the first surface of the second substrate; and at least one second electrical lead formed on the second substrate, a first end of the at least one second electrical lead being electrically connected to the antenna, a second end of each second electrical lead being positioned adjacent the first edge of the second substrate, wherein the first edge of the second substrate is mounted to the first surface of the first substrate such that each first electrical lead is electrically connected to the second end of a corresponding second electrical lead, wherein the first surface of the first substrate further includes a channel formed therein, and wherein the first edge of the second substrate is positioned in at least a portion of the channel.

17. An integrated circuit antenna structure for transmitting, receiving, or transceiving electromagnetic radiation, the antenna structure comprising:

a first substrate having a first surface;

at least one first electrical lead formed on the first surface of the first substrate;

a second substrate having a first surface and a first edge;

an antenna for transmitting, receiving, or transceiving electromagnetic radiation, wherein the antenna is formed on the first surface of the second substrate; and at least one second electrical lead formed on the second substrate, a first end of the at least one second electrical lead being electrically connected to the antenna, a second end of each second electrical lead being positioned adjacent the first edge of the second substrate, wherein the first edge of the second substrate is mounted to the first surface of the first substrate such that each first electrical lead is electrically connected to the second end of a corresponding second electrical lead, and wherein a longitudinal axis of the antenna is normal to the first surface of the first substrate.

18. An integrated circuit antenna array structure for transmitting, receiving, or transceiving electromagnetic radiation, the antenna array structure comprising:

a first substrate having a first surface, said first substrate being a semi-conductor;

a plurality of first electrical leads formed on the first surface of the first substrate;

at least one secondary substraete, each secondary substrate having a first surface and a first edge;

at least two antennae for transmitting, receiving, or transceiving electromagnetic radiation, each antenna being formed on the first surface of a secondary substrate; and at least one second electrical lead for each antenna, each second electrical lead being formed on a surface of a corresponding secondary substrate, a first end of each second electrical lead being electrically connected to a respective antenna, a second end of each second electrical lead being positioned adjacent the first edge of a corresponding secondary substrate, wherein the first edge of each secondary substrate is mounted to the first surface of the first substrate such that each first electrical lead is electrically connected to the second end of a corresponding second electrical lead.

19. An integrated circuit antenna array structure in accordance with claim 18, wherein the first substrate further includes is electronic circuitry formed on at least one surface thereof, wherein the electronic circuitry is electrically connected to each of the first electrical leads, and wherein the electronic circuitry is adapted for driving at least one of the first electrical leads such that a corresponding antenna transmits electromagnetic radiation.

20. An integrated circuit antenna array structure in accordance with claim 18, wherein the first substrate further includes electronic circuitry formed on at least one surface thereof, wherein the electronic circuitry is electrically connected to each of the first electrical leads, and wherein the electronic circuitry is adapted for receiving an electrical signal, from at least one of the first electrical leads, indicative of a corresponding antenna receiving electromagnetic radiation.

21. An integrated circuit antenna array structure in accordance with claim 18, wherein the first substrate further includes electronic circuitry formed on at least one surface thereof, wherein the electronic circuitry is electrically connected to each of the first electrical leads, wherein the electronic circuitry is adapted for driving at least one of the first electrical leads such that a corresponding antenna transmits electromagnetic radiation, and wherein the electronic circuitry is adapted for receiving an electrical signal, from at least one of the first electrical leads, indicative of a corresponding antenna receiving electromagnetic radiation.

22. An integrated circuit antenna array structure in accordance with claim 18, wherein each secondary substrate is directly mounted to the first substrate at a non-zero angle so that each first electrical lead physically contacts the second end of a corresponding second electrical lead.

23. An integrated circuit antenna array structure in accordance with claim 18, wherein the first surface of the first substrate further defines at least one slot formed therein, wherein the first edge of the secondary substrate has at least one tab, wherein the at least one first electrical lead is at least partially formed within the at least one slot, wherein at least one of the at least one tab has a second electrical lead formed at least partially thereon, and wherein each tab is adapted to be positioned in a respective slot such that the at least one first electrical lead within the at least one slot is electrically coupleable to the second electrical lead on the at least one tab.

24. An integrated circuit antenna array structure in accordance with claim 18, wherein an angle formed between the first substrate and each of the at least one secondary substrate is substantially 90 degrees.

25. An integrated circuit antenna array structure in accordance with claim 18, wherein a surface of each of the at least one secondary substrate includes at least one director formed thereon, the director increasing directionality of the electromagnetic radiation emitted or received by an antenna.

26. An integrated circuit antenna array structure in accordance with claim 18, wherein each of the at least one antenna is one of a dipole antenna, a bow-tie antenna, a spiral antenna, and a log periodic antenna.

27. An integrated circuit antenna array structure in accordance with claim 18, wherein a ground plane is formed on a second surface of the first substrate, the second surface of the first substrate being opposite the first surface of the first substrate.

28. An integrated circuit antenna structure in accordance with claim 18, wherein a longitudinal axis of each antenna is parallel to the first surface of the first substrate.

29. An integrated circuit antenna array structure in accordance with claim 18, wherein the at least one secondary substrate comprises a first secondary substrate and a second secondary substrate, wherein a first antenna is formed on the surface of the first secondary substrate, and a second antenna is formed on the surface of the second secondary substrate, and wherein an angle formed between the first secondary substrate and the second secondary substrate is substantially 90 degrees.

30. An integrated circuit antenna array structure in accordance with claim 29, wherein a phase of a signal received from each antenna is sensed such that a direction from which the integrated circuit antenna array structure receives electromagnetic radiation is determined.

31. An integrated circuit antenna array structure in accordance with claim 18, wherein the at least one secondary substrate is a plurality of secondary substrates, wherein each secondary substrate includes at least two antennae, and wherein the secondary substrates are parallel to each other and are positioned apart from one another so as to form a two-dimensional array of the antennae.

32. An integrated circuit antenna array structure in accordance with claim 31, wherein the secondary substrates are parallel to each other and are positioned apart from one another so as to form a periodic two-dimensional array of the antennae.

33. An integrated circuit antenna array structure in accordance with claim 18, wherein the at least one secondary substrate is a plurality of secondary substrates, and wherein an angle formed between neighboring ones of the plurality of secondary substrates is substantially 90 degrees.

34. An integrated circuit antenna array structure in accordance with claim 33, wherein the secondary substrates are positioned apart from one another so as to form a two-dimensional array of the antennae.

35. An integrated circuit antenna array structure in accordance with claim 33, wherein the secondary substrates are positioned apart from one another so as to form a periodic two-dimensional array of the antennae.

36. An integrated circuit antenna structure in accordance with claim 18, further including at least two antenna loads, each antenna load electrically connected to a corresponding one of the at least two antennae, each antenna load converting electromagnetic radiation received by a corresponding antenna into an electrical indicia thereof.

37. An integrated circuit antenna structure in accordance with claim 36, wherein the electrical indicia is one of a change in resistance, a change in voltage, and a change in current.

38. An integrated circuit antenna structure in accordance with claim 18, wherein the first substrate is planar.

39. An integrated circuit antenna structure in accordance with claim 18, wherein each secondary substrate is planar.

40. An integrated circuit antenna array structure for transmitting, receiving, or transceiving electromagnetic radiation, the antenna array structure comprising:

a first substrate having a first surface;

a plurality of first electrical leads formed on the first surface of the first substrate;

at least one secondary substrate, each secondary substrate having a first surface and a first edge;

at least two antennae for transmitting, receiving, or transceiving electromagnetic radiation, each antenna being formed on the first surface of a secondary substrate; and at least one second electrical lead for each antenna, each second electrical lead being formed on a surface of a corresponding secondary substrate, a first end of each second electrical lead being electrically connected to a respective antenna, a second end of each second electrical lead being positioned adjacent the first edge of a corresponding secondary substrate, wherein the first edge of each secondary substrate is mounted to the first surface of the first substrate such that each first electrical lead is electrically connected to the second end of a corresponding second electrical lead, wherein the first surface of the first substrate further includes at least one channel formed therein, and wherein the first edge of each secondary substrate is positioned in at least a portion of a corresponding channel.

41. An integrated circuit antenna array structure for transmitting, receiving, or transceiving electromagnetic radiation, the antenna array structure comprising:

a first substrate having a first surface;

a plurality of first electrical leads formed on the first surface of the first substrate;

at least one secondary substrate, each secondary substrate having a first surface and a first edge;

at least two antennae for transmitting, receiving, or transceiving electromagnetic radiation, each antenna being formed on the first surface of a secondary substrate; and at least one second electrical lead for each antenna, each second electrical lead being formed on a surface of a corresponding secondary substrate, a first end of each second electrical lead being electrically connected to a respective antenna, a second end of each second electrical lead being positioned adjacent the first edge of a corresponding secondary substrate, wherein the first edge of each secondary substrate is mounted to the first surface of the first substrate such that each first electrical lead is electrically connected to the second end of a corresponding second electrical lead, and wherein a longitudinal axis of the first antenna and a longitudinal axis of the second antenna is normal to the first surface of the first substrate.

42. An integrated circuit antenna array structure in accordance with claim 41, further comprising:

a first driver for generating a first signal to drive the first antenna, a second driver for generating a second signal to drive the second antenna, and a controller for controlling a phase difference between the first signal and the second signal, wherein the phase difference is adapted such that the integrated circuit antenna array structure transmits electromagnetic radiation in a predetermined direction.

43. An integrated circuit antenna array structure in accordance with claim 41, wherein a phase of a first signal received from the first antenna and a phase of a second signal received from the second antenna is sensed such that a direction from which the integrated circuit antenna array structure receives electromagnetic radiation is determined.

44. An integrated circuit antenna array structure for transmitting, receiving, or transceiving electromagnetic radiation, the antenna array structure comprising:

a first substrate having a first surface;

a plurality of first electrical leads formed on the first surface of the first substrate;

at least one secondary substrate, each secondary substrate having a first surface and a first edge;

at least two antennae for transmitting, receiving, or transceiving electromagnetic radiation, each antenna being formed on the first surface of a secondary substrate; and at least one second electrical lead for each antenna, each second electrical lead being formed on a surface of a corresponding secondary substrate, a first end of each second electrical lead being electrically connected to a respective antenna, a second end of each second electrical lead being positioned adjacent the first edge of a corresponding secondary substrate, wherein the first edge of each secondary substrate is mounted to the first surface of the first substrate such that each first electrical lead is electrically connected to the second end of a corresponding second electrical lead, wherein the at least one secondary substrate is a plurality of secondary substrates, wherein the secondary substrates are radially configured, and wherein an axis of each antenna is normal to the first surface of the first substrate.

45. An integrated circuit antenna array structure in accordance with claim 44, further comprising:

a plurality of drivers, each driver for generating a signal to drive a corresponding antenna, and a controller for controlling a phase difference between the plurality of signals, wherein the phase difference is adapted such that the integrated circuit antenna array structure transmits electromagnetic radiation in a predetermined direction.

46. An integrated circuit antenna array structure for receiving electromagnetic radiation, the antenna array structure comprising:

a first substrate having a first surface;

a plurality of first electrical leads formed on the first surface of the first substrate;

electronic circuitry formed on at least one surface of the first substrate, the electronic circuitry being electrically connected to each of the first electrical leads, the electronic circuitry being adapted for receiving electrical signals from at least one of the first electrical leads;

a ground plane formed on a second surface of the first substrate, the second surface of the first substrate being opposite the first surface of the first substrate;

at least two secondary substrates, each secondary substrate having a first surface and a first edge;

at least four antennae for receiving electromagnetic radiation, each antenna being formed on a surface of a secondary substrate, a longitudinal axis of each antenna being parallel to the first surface of the first substrate; and at least one second electrical lead for each antenna, each second electrical lead being formed on a surface of a corresponding secondary substrate, a first end of each second electrical lead being electrically connected to a respective antenna, a second end of each second electrical lead being positioned adjacent the first edge of a corresponding secondary substrate, wherein the first edge of each secondary substrate is mounted to the first surface of the first substrate such that each first electrical lead is electrically connected to the second end of a corresponding second electrical lead, wherein the secondary substrates are positioned apart from one another so as to form a two-dimensional array of antennae, wherein an angle formed between the first substrate and each of the secondary substrates is substantially 90 degrees, and wherein at least one of said first and at least two secondary substrates is a semi-conductor.

47. An integrated circuit antenna array structure in accordance with claim 46, wherein the first surface of the first substrate further defines at least one slot formed therein, wherein the first edge of the secondary substrate has at least one tab, and wherein each tab is adapted to be disposed in a respective slot.

48. An integrated circuit antenna array structure in accordance with claim 46, wherein an angle formed between the first substrate and each of the at least one secondary substrate is substantially 90 degrees.

49. An integrated circuit antenna array structure in accordance with claim 46, wherein a surface of each secondary substrate includes at least one director formed thereon, each director increasing directionality of the electromagnetic radiation received by a corresponding antenna.

50. An integrated circuit antenna array structure in accordance with claim 46, wherein an angle formed between neighboring ones of the plurality of secondary substrates is substantially 90 degrees.

51. An integrated circuit antenna structure in accordance with claim 46, further including at least four antenna loads, each antenna load electrically connected to a corresponding one of the at least four antennae, each antenna load converting electromagnetic radiation received by a corresponding antenna into an electrical indicia thereof.

52. An integrated circuit antenna structure in accordance with claim 51, wherein the electrical indicia is one of a change in resistance, a change in voltage, and a change in current.

53. An integrated circuit antenna structure in accordance with claim 46, wherein the first substrate is planar.

54. An integrated circuit antenna structure in accordance with claim 46, wherein each secondary substrate is planar.

55. An integrated circuit antenna array structure for receiving electromagnetic radiation, the antenna array structure comprising:

a first substrate having a first surface;

a plurality of first electrical leads formed on the first surface of the first substrate;

electronic circuitry formed on at least one surface of the first substrate, the electronic circuitry electrically connected to each of the first electrical leads, the electronic circuitry being adapted for receiving electrical signals from at least one of the first electrical leads;

a ground plane formed on a second surface of the first substrate, the second surface of the first substrate being opposite the first surface of the first substrate;

at least two secondary substrates, each secondary substrate having a first surface and a first edge;

at least four antennae for receiving electromagnetic radiation, each antenna being formed on a surface of a secondary substrate, a longitudinal axis of each antenna being parallel to the first surface of the first substrate; and at least one second electrical lead for each antenna, each second electrical lead being formed on a surface of a corresponding secondary substrate, a first end of each second electrical lead being electrically connected to a respective antenna, a second end of each second electrical lead being positioned adjacent the first edge of a corresponding secondary substrate, wherein the first edge of each secondary substrate is mounted to the first surface of the first substrate such that each first electrical lead is electrically connected to the second end of a corresponding second electrical lead, wherein the secondary substrates are positioned apart from one another so as to form a two-dimensional array of antennae, and wherein an angle formed between the first substrate and each of the secondary substrates is substantially 90 degrees, wherein the first surface of the first substrate further includes at least two channels formed therein, and wherein the first edge of each secondary substrate is positioned in at least a portion of a corresponding channel.

56. An integrated circuit structure for transmitting, receiving, or transceivinng electromagnetic radiation, the structure comprising:

a first substrate having a first surface;

at least one first electrical lead formed on the first surface of the first substrate;

a second substrate having a first surface and a first edge; and at least one second electrical lead formed on the second substrate, an end of each second electrical lead being positioned adjacent the first edge of the second substrate;

wherein the first edge of the second substrate is mounted to the first surface of the first substrate such that each first electrical lead is electrically connected to the end of a corresponding second electrical lead, and wherein at least one of the first and second substrates is a semi-conductor.

57. An integrated circuit having an antenna structure for transmitting, electromagnetic radiation, the integrated circuit comprising:

a first substrate having at least a first surface, the first substrate being a semi-conductor, the first substrate including electronic circuitry formed on at least one surface thereof;

at least one first electrical lead formed on the first surface of the first substrate;

a second substrate having a first surface and a first edge;

an antenna for transmitting, receiving, or transceiving electromagnetic radiation, wherein the antenna is formed on the first surface of the second substrate; and at least one second electrical lead formed on the second substrate, a first end of the at least one second electrical lead being electrically connected to the antenna, a second end of each second electrical lead being positioned adjacent the first edge of the second substrate, wherein the first edge of the second substrate is mounted to the first surface of the first substrate such that each first electrical lead is electrically connected to the second end of a corresponding second electrical lead, wherein the electronic circuitry is electrically connected to the at least one first electrical lead, and wherein the electronic circuitry is adapted for driving the at least one first electrical lead such that the antenna transmits electromagnetic radiation.

58. An integrated circuit having an antenna structure for receiving electromagnetic radiation, the integrated circuit comprising:

a first substrate having at least a first surface, the first substrate being a semi-conductor, the first substrate including electronic circuitry formed on at least one surface thereof;

at least one first electrical lead formed on the first surface of the first substrate;

a second substrate having a first surface and a first edge;

an antenna for transmitting, receiving, or transceiving electromagnetic radiation, wherein the antenna is formed on the first surface of the second substrate; and at least one second electrical lead formed on the second substrate, a first end of the at least one second electrical lead being electrically connected to the antenna, a second end of each second electrical lead being positioned adjacent the first edge of the second substrate, wherein the first edge of the second substrate is mounted to the first surface of the first substrate such that each first electrical lead is electrically connected to the second end of a corresponding second electrical lead, wherein the electronic circuitry is electrically connected to the at least one first electrical lead, and wherein the electronic circuitry is adapted for receiving an electrical signal, from the at least one first electrical lead, indicative of the antenna receiving electromagnetic radiation.

59. An integrated circuit having an antenna structure for transceiving electromagnetic radiation, the integrated circuit comprising:

a first substrate having at least a first surface, the first substrate being a semi-conductor, the first substrate including electronic circuitry formed on at least one surface thereof;

at least one first electrical lead formed on the first surface of the first substrate;

a second substrate having a first surface and a first edge;

an antenna for transmitting, receiving, or transceiving electromagnetic radiation, wherein the antenna is formed on the first surface of the second substrate; and at least one second electrical lead formed on the second substrate, a first end of the at least one second electrical lead being electrically connected to the antenna, a second end of each second electrical lead being positioned adjacent the first edge of the second substrate, wherein the first edge of the second substrate is mounted to the first surface of the first substrate such that each first electrical lead is electrically connected to the second end of a corresponding second electrical lead, wherein the electronic circuitry is electrically connected to at least one first electrical lead, wherein the electronic circuitry is adapted for driving the at least one first electrical lead such that the antenna transmits electromagnetic radiation, and wherein the electronic circuitry is adapted for receiving an electrical signal, from the at least one first electrical lead, indicative of the antenna receiving electromagnetic radiation.

* * * * *

UNITED STATES PATENT AND TRADEMARK OFFICE

CERTIFICATE OF CORRECTION

PATENT NO. : 6,359,596 B1 
DATED : March 19, 2002
INVENTOR(S) : Lewis T. Claiborne It is certified that error appears in the above-identified patent and that said Letters Patent is hereby corrected as shown below:

Column 8,
Line 60, delete "substraete,", and insert -- substrate --.

Column 9,
Line 13, delete "is".

Column 14,
Line 50, delete "transceivinng", and insert -- transceiving --.

Signed and Sealed this

Eleventh Day of June, 2002

*Attest:*

*Attesting Officer*

JAMES E. ROGAN
*Director of the United States Patent and Trademark Office*